US007663550B2

(12) United States Patent
Takei et al.

(10) Patent No.: US 7,663,550 B2
(45) **Date of Patent: *Feb. 16, 2010**

(54) DISTRIBUTED PHASE TYPE CIRCULAR POLARIZED WAVE ANTENNA AND HIGH-FREQUENCY MODULE USING THE SAME

(75) Inventors: Ken Takei, Hitachi (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 121 days.

This patent is subject to a terminal disclaimer.

(21) Appl. No.: 11/353,250

(22) Filed: Feb. 14, 2006

(65) Prior Publication Data

US 2006/0197706 A1 Sep. 7, 2006

(30) Foreign Application Priority Data

Feb. 14, 2005 (JP) ..... 2005-036001

(51) Int. Cl.
*H01Q 1/38* (2006.01)

(52) U.S. Cl. ..... 343/700 MS

(58) Field of Classification Search ..... 343/700 MS, 343/702, 853, 846, 793
See application file for complete search history.

(56) References Cited

U.S. PATENT DOCUMENTS 5,264,861 A 11/1993 Roederer et al.
5,526,007 A 6/1996 Murakami et al.
6,040,806 A * 3/2000 Kushihi et al. ..... 343/853
6,329,955 B1 * 12/2001 McLean et al. ..... 343/742
6,512,475 B1 * 1/2003 Bogatyrev et al. ..... 342/22
6,727,858 B2 4/2004 Iijima
6,995,709 B2 * 2/2006 Spittler ..... 343/700 MS
7,034,770 B2 * 4/2006 Yang et al. ..... 343/793
7,123,203 B2 10/2006 Le Geoff et al.
2004/0001021 A1 * 1/2004 Choo et al. ..... 343/700 MS
2005/0140556 A1 * 6/2005 Ohno et al. ..... 343/770

(Continued)

FOREIGN PATENT DOCUMENTS

JP 1-158805 6/1989

(Continued)

OTHER PUBLICATIONS

Goto, Naohisa, "Illustrated antenna (zusetsu antenna)", Institute of Electronics, Information and Communication Engineers, 1995, p. 219.

(Continued)

*Primary Examiner*—Huedung Mancuso
(74) *Attorney, Agent, or Firm*—McGinn IP Law Group, PLLC

(57) ABSTRACT

A distributed phase type circular polarized wave antenna is composed of a group of narrow conductor lines 2*a*, 2*b*, 2*c* and 2*d*, and the group of the narrow conductor lines 2*a*, 2*b*, 2*c* and 2*d* are laid out in a two-dimensional plane. Complex vectorial sums of respective projections of current induced in each point of the narrow conductor lines 2*a*, 2*b*, 2*c* and 2*d* in two directions orthogonal to each other in the two-dimensional plane are determined, such that amplitudes of the complex vectorial sums are equal to each other in the two directions and a phase difference between the complex vectorial sums in the two directions is 90°.

26 Claims, 10 Drawing Sheets

U.S. PATENT DOCUMENTS

2006/0092079 A1* 5/2006 de Rochemont ..... 343/700 MS

FOREIGN PATENT DOCUMENTS

| | | |
|---|---|---|
| JP | 5-152842 | 6/1993 |
| JP | 5-275918 | 10/1993 |
| JP | 2002-76765 | 3/2002 |
| JP | 2003-101341 | 4/2003 |
| JP | 2005-530439 | 10/2005 |
| WO | WO 2004/001900 | 12/2003 |

OTHER PUBLICATIONS

Haneishi, Misao, et al., "Small size plane antenna", Institute of Electronics, Information and Communication Engineers, 1996, p. 143-145.

Japanese Office Action dated Oct. 21, 2008 with English-Language Translation.

* cited by examiner

DISTRIBUTED PHASE TYPE CIRCULAR POLARIZED WAVE ANTENNA AND HIGH-FREQUENCY MODULE USING THE SAME

The present application is based on Japanese Patent Application No. 2005-036001 filed on Feb. 14, 2005, the entire contents of which are incorporated herein by reference.

BACKGROUND OF THE INVENTION

1. Field of the Invention

The present invention relates to an antenna, a high-frequency module mounting the same, or a radio terminal that are applied to a radio communication-related equipment for providing a user with a radio communication system service, such as satellite broadcasting, global positioning system (GPS) using a circular polarized wave, in more particularly, to a small-sized thin type distributed phase type circular polarized wave antenna, a high-frequency module including the antenna, and a radio terminal mounting them, which is suitable for providing the user with information transmission radio communication system by the medium of electromagnetic wave having a wavelength greater than dimensions of the radio terminal.

2. Description of the Related Art

Among various radio communication system, many satellite-using systems such as seamless international telephone, satellite broadcasting, GPS, are operated, by making full use of advantages thereof, e.g. a seamless services over different countries can be provided, and a shielding effect of tall structures is small, since an electromagnetic wave used as a communication medium is transmitted from a substantially vertical (zenith) direction.

On one hand, the seamless services can be provided internationally. On the other hand, a possibility that the electromagnetic wave is leaked to other countries and other regions is inevitably highs so that different polarized waves (right-handed circular polarized wave and left-handed circular polarized wave) are assigned to neighboring countries and neighboring regions by using circular polarized wave, so as to solve the problem of electromagnetic wave leakage. The right-handed circular polarized wave cannot be received by a left-handed circular polarized wave antenna, and the left-handed circular polarized wave cannot be received by a right-handed circular polarized wave antenna. Only a half power of the circular polarized wave can be received by a linear polarized wave antenna. Therefore, so as to provide effectively the user with a radio communication services using the electromagnetic wave of a circular polarized wave, means for realizing the circular polarized wave antenna becomes an important technical problem.

As the means for realizing circular polarized wave antenna, two methods are conventionally known and are put to practical use.

A first conventional method is to dispose two linear polarized wave antennas orthogonally to each other, and feeding phases of the respective antennas are shifted by 90°. A cross dipole is well known as a representative example of the first conventional method, as shown in "Illustrated antenna (zusetsu antenna)" by Naohisa Goto, 1995, Institute of Electronics, Information and Communication Engineers, page 219. However, in the first conventional method, two power feed parts are required, and means for shifting the respective power feed parts by 90° (e.g. phase converter) are further required. In the first conventional method, there is a disadvantage in that a circuit size of a radio communication device using the antenna is enlarged, so that there is problem in miniaturization of the radio communication device.

A second conventional method is to use a periphery-opened patch antenna such as a microstrip antenna, namely, to realize a circular polarized wave antenna with a single power feed point by using a rectangular or circular two-dimensional patch, which extends along two axes orthogonal to each other. For example, as shown in "Small size plane antenna" by Misao Haneishi et al, 1996, Institute of Electronics, Information and Communication Engineers, pages 143 to 145, a regular square or circle is such deformed that one side is shorter and another side is longer along the two axes orthogonal to each other. As a result, a length of one side of the regular square or a half circumference length of one side of the circle is made different from another side, and the length of each side is slightly shorter or longer than ½ wavelength of the receiving wavelength. Viewed from a power feed point, the length of the side along the respective axes orthogonal to each other functions as inductance or capacitance, and a feeding phase to the length of the side of the respective axes is shifted by 90°. The second conventional method is more advantageous than the first conventional method, since only the single power feed point is provided and a circuit size of a high-frequency circuit for supplying a high-frequency power to the antenna can be significantly reduced. Therefore, the second conventional method is actually most commercialized.

However, when using the second conventional method, two-dimensional size of substantially ½ wavelength of the radio wave received by the antenna should be assured as outer dimensions of the antenna, namely, an area of a regular square having one side of substantially ½ wavelength should be assured. Accordingly, there is an obstacle for application to a palm sized small terminal that is currently desired.

So as to reduce the dimensions of the antenna according to the second conventional method, a technology for miniaturizing an antenna by using a wavelength compact effect of a dielectric material, in which the antenna is lined with or covered with a dielectric material having a high dielectric constant.

However, another problem in miniaturization is occurred, for example, a fabrication cost is increased by using the dielectric material having the high dielectric constant, and a dimension of the dielectric material in a thickness direction is increased so as to mostly produce the wavelength compact effect of the dielectric material.

SUMMARY OF THE INVENTION

Accordingly, it is an object of the present invention to provide a distributed phase type circular polarized wave antenna, which provide the user with a radio communication service using an electromagnetic wave of circular polarized wave, represented by a satellite radio communication system, with a single feed which is simplest in structure and small and thin dimensions, and without adding a separate medium such as dielectric material for realizing wavelength compact effect that may cause an increase in cost, and to provide also a high-frequency module using the circular polarized wave antenna, or a radio terminal using the same.

According to a first feature of the invention, a distributed phase type circular polarized wave antenna comprises:

a plane:

a power feed point formed on the plane; and a plurality of narrow conductors having a substantially one-dimensional current distribution, the narrow conductor groups being distributed in two dimension on the plane;

wherein:

absolute values of sums of projections of complex vectors of current distributions induced on the narrow conductors in first and second directions orthogonal to each other defined on the plane are determined in amplitude and phase, such that an amplitude ratio of the absolute values is from 0.7 to 1.3 and a phase difference of the absolute values is from 80° to 100°.

According to a second feature of the invention, in the distributed phase type circular polarized wave antenna, the narrow conductors are coupled to each other and the power feed point is included in the narrow conductors.

According to a third feature of the invention, in the distributed phase type circular polarized wave antenna, the narrow conductors are formed on a grounded conductor plate having a finite grounding potential.

According to a fourth feature of the invention, in the distributed phase type circular polarized wave antenna, a space between the narrow conductors and the conductor plate is filled with a dielectric material.

According to a fifth feature of the invention, in the distributed phase type circular polarized wave antenna, a space between the narrow conductors and the conductor plate is filled with a dielectric material.

According to a sixth feature of the invention, the distributed phase type circular polarized wave antenna further comprises a thin dielectric sheet laminating the narrow conductors.

According to a seventh feature of the invention, the distributed phase type circular polarized wave antenna further comprises a coaxial cable having an end coupled to the power feed point and another end being a power feed point for connection to outside.

According to an eighth feature of the invention, the distributed phase type circular polarized wave antenna further comprises a flexible printed cable having an end coupled to the power feed point and another end being a power feed point for connection to outside.

According to a ninth feature of the invention, the distributed phase type circular polarized wave antenna further comprises:

a layered conductor comprising dielectric layers formed on a surface of the grounded conductor plate; and a conductor formed in the dielectric material, the conductor being connected to the power feed point and coupled to the layered conductor.

According to a tenth feature of the invention, the distributed phase type circular polarized wave antenna further comprises:

a layered conductor comprising dielectric layers formed on a surface of the grounded conductor plate; and a conductor formed on a side surface of the dielectric material, the conductor being connected to the power feed point and coupled to the layered conductor.

According to an eleventh feature of the invention, the distributed phase type circular polarized wave antenna further comprises:

a layered conductor comprising dielectric layers formed on a surface of the grounded conductor plate; and a conductor formed in the magnetic material, the conductor being connected to the power feed point and coupled to the layered conductor.

According to a twelfth feature of the invention, the distributed phase type circular polarized wave antenna further comprises:

a layered conductor comprising dielectric layers formed on a surface of the grounded conductor plate; and a conductor formed on a side surface of the magnetic material, the conductor being connected to the power feed point and coupled to the layered conductor.

According to a thirteenth feature of the invention, a distributed phase type circular polarized wave antenna comprises:

a convex curved surface;

a power feed point formed on the convex curved surface; and a plurality of narrow conductors having a substantially one-dimensional current distribution, the narrow conductor groups being distributed in two dimension on the convex curved surface;

wherein:

absolute values of sums of projections, on a plane contacting the convex curved surface, of complex vector additional values of current distributions induced on the narrow conductors in first and second directions orthogonal to each other defined on the convex curved surface are determined in amplitude and phase, such that an amplitude ratio of the absolute values is from 0.7 to 1.3 and a phase difference of the absolute values is from 80° to 100°.

According to a fourteenth feature of the invention, a high-frequency module comprises;

a distributed phase type circular polarized wave antenna which comprises:

a plane;

a power feed point formed on the plane; and a plurality of narrow conductors having a substantially one-dimensional current distribution, the narrow conductor groups being distributed in two dimension on the plane;

wherein:

absolute values of sums of projections of complex vectors of current distributions induced on the narrow conductors in first and second directions orthogonal to each other defined on the plane are determined in amplitude and phase, such that an amplitude ratio of the absolute values is from 0.7 to 1.3 and a phase difference of the absolute values is from 80° to 100°.

According to a fifteenth feature of the invention, a portable radio terminal comprises:

a distributed phase type circular polarized wave antenna which comprises:

a plane;

a power feed point formed on the plane; and a plurality of narrow conductors having a substantially one-dimensional current distribution, the narrow conductor groups being distributed in two dimension on the plane;

wherein:

absolute values of sums of projections of complex vectors of current distributions induced on the narrow conductors in first and second directions orthogonal to each other defined on the plane are determined in amplitude and phase, such that an amplitude ratio of the absolute values is from 0.7 to 1.3 and a phase difference of the absolute values is from 80° to 100°.

According to a sixteenth feature of the invention, in the portable radio terminal, a high-frequency module includes the distributed phase type circular polarized wave antenna.

According to the present invention, it is possible to realize a small sized single feed circular polarized wave antenna without using a wavelength compact material such as dielectric material. Therefore, it is possible to realize a small sized circular polarized wave antenna without further increasing the fabrication cost, and to realize a thin module including this small sized thin antenna, and further it is effective to miniaturize and slim a radio terminal in a radio communication system by using this antenna and this module.

BRIEF DESCRIPTION OF THE DRAWINGS

Preferred embodiments present invention will be described in conjunction with appended drawings, wherein:

FIGS. 4A and 4B are diagrams showing a conductor pattern of a distributed phase type circular polarized wave antenna, wherein FIG. 4A shows a conductor pattern in a second preferred embodiment and FIG. 4B shows a conductor pattern in a third preferred embodiment;

FIGS. 5A and 5B are diagrams showing a conductor pattern of a distributed phase type circular polarized wave antenna, wherein FIG. 5A shows a conductor pattern in a fourth preferred embodiment and FIG. 5B shows a conductor pattern in a fifth preferred embodiment according to the invention;

FIGS. 10A and 10B are diagrams showing a high-frequency module in a tenth preferred embodiment according to the invention, wherein FIG. 10A is a plan view, and FIG. 10B is a cross sectional view of FIG. 10A cut along A-A' line;

FIGS. 11A and 11B are diagrams showing a high-frequency module in an eleventh preferred embodiment according to the invention, wherein FIG. 11A is a plan view, and FIG. 11B is a cross sectional view of FIG. 11A cut along A-A' line;

FIGS. 12A and 12B are diagrams showing a high-frequency module in a twelfth preferred embodiment according to the invention, wherein FIG. 12A is a plan view, and FIG. 12B is a cross sectional view of FIG. 12A cut along A-A' line;

FIGS. 13A, 13B and 13*c* are diagrams showing a high-frequency module in a thirteenth preferred embodiment according to the invention, wherein FIG. 13A is a plan view, and FIG. 13B is a cross sectional view of FIG. 13A cut along A-A' line;

DETAILED DESCRIPTION OF THE PREFERRED EMBODIMENTS

Figure 1:
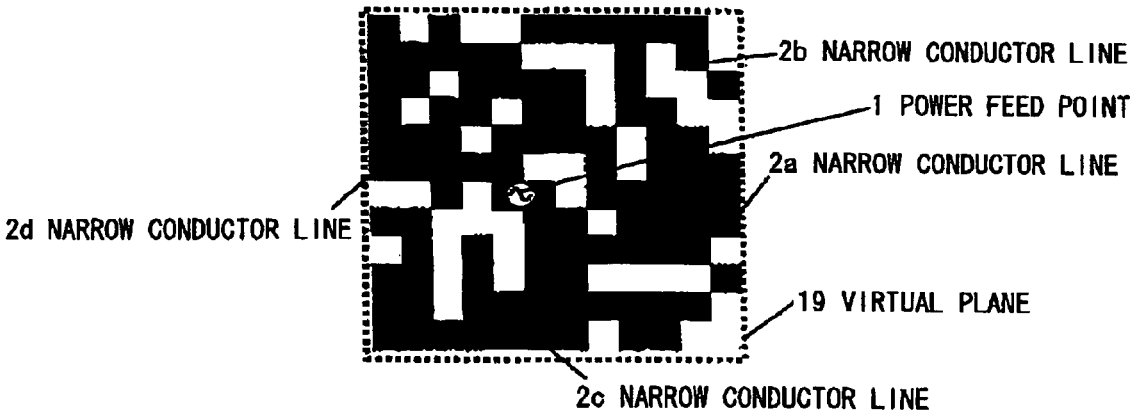
FIG. 1 is a diagram showing a conductor pattern of a distributed phase type circular polarized wave antenna in a first preferred embodiment according to the invention.

Next, preferred embodiments according to the present invention will be explained in more detail in conjunction with appended drawings, First of all, a basic theory of the present invention will be explained.

As shown in JP-A-1-158805, the electrical configuration of an antenna can be described by using leakage loss transmission lines. The leakage loss transmission line may be expressed by a following formula (1).

$$Z_c \tan(\beta L - j\alpha L^n) \quad (1)$$

wherein $Z_c$ is a characteristic impedance, $\beta$ is a propagation coefficient, $\alpha$ is a loss coefficient, n is a nonlinear leakage coefficient, and L is a line length.

It is assumed that the formula (1) means a following fact. In case where an antenna is composed of leakage loss transmission lines, in other words, when an antenna in which a current is distributed in one dimension is composed of a group of conductor lines having a width which is sufficiently narrow compared with a used wavelength, a reactance component and a resistance component are distributed in each line in accordance with a manner of distribution multiplier, a current distribution induced on the conductor lines at each point on the lines composing the antenna has a particular amplitude and a particular phase.

In accordance with the above assumption, if one point in the conductor line is provided as a power feed point in the group of the narrow conductor lines, an induced current is generated in the conductor line by electromagnetic phenomenon, even in the conductor line where a pass connected to the power feed point is not provided. Therefore, a complex intensity distribution of the current distribution having a particular amplitude and a particular phase to the power feed point is generated in each point of the respective conductor lines.

On the other hand, when considering a circular polarized wave from a view point of a receiving side of the circular polarized wave, the circular polarized wave antenna is a plane perpendicular to a direction along which the circular polarized wave is transmitted, in which electromagnetic waves in two directions orthogonal to each other have an equal intensity and phases different from each other by 90°.

According to the theories of the electromagnetics, a direction of a current flowing on the conductor and a direction of an electric field of an electromagnetic wave generated by the current are identical when viewed from a far point. Therefore, if following conditions are satisfied, a novel circular polarized wave antenna can be realized.

Firstly, a group of narrow conductor lines composing the antenna are formed on a same plane and one point in the group of narrow conductor lines is provided as a power feed point. Each of the narrow conductor lines is divided to be sufficiently small (1/50 or less). Then, a sum of projections of complex vectors of induced current at each divided point to two axes orthogonal to each other that are arbitrarily provided on a same plane is calculated for each axis. If amplitudes of the sums of respective axes are equal to each other and a phase difference in the sums of the respective axes is 90°, the group of the narrow conductor lines composes a circular polarized wave antenna.

In the antenna according to a novel principle using a concept of leakage loss transmission lines, the power feed point is single, and there is no limitation of "dimensions with substantially ½ wavelength" described in the background of the invention. Accordingly, there is a possibility of realizing a small sized antenna in which a limit of antenna dimensions in the prior art can be broken through.

Various design algorithms for producing a concrete antenna structure according to this novel principle can be thought. As the simplest algorithm, following method may be proposed. Firstly, an area to be occupied by an antenna is previously provided. The area is divided into small areas (for example, rectangular areas). Then, a calculator randomly determines as to whether a conductor remains or not in each of the divided small areas. On a conductor distribution pattern corresponding to a group of the narrow conductor lines obtained by the above calculation (dimensions of the small area corresponds to a narrow conductor), a power feed point is randomly selected, to provide probable circular polarized wave antennas according to the novel principle. Finally, the probable circular polarized wave antennas (candidate antennas) are examined as needed whether a circular polarized wave can be really generated.

By a random search of the antenna according to the novel principle, a small sized plate like circular polarized wave antenna in a square area with dimensions less than ¼ wavelength can be obtained as shown in FIG. 1.

The obtained result demonstrates an effect for realizing a small sized circular polarized wave antenna without increasing a fabrication cost, since a single feed circular polarized wave antenna having dimensions significantly smaller than that of the conventional circular polarized wave antenna (a regular square having one side length of substantially ½ wavelength) is realized without using a wavelength compact material.

Next, a distributed phase type circular polarized wave antenna in a first preferred embodiment according to the invention will be explained referring to FIG. 1.

FIG. 1 is a diagram showing a structure of a distributed phase type circular polarized wave antenna in the first preferred embodiment according to the invention.

On a virtual plane 19, a power feed point 1 and a group of narrow conductor lines 2*a*, 2*b*, 2*c*, and 2*d* are formed.

The search for the antenna structure according to the invention is conducted as follows.

Figure 2:
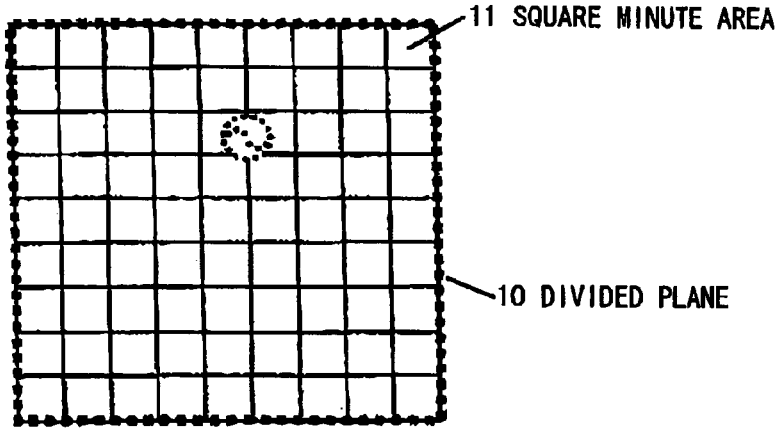
FIG. 2 is a diagram showing a divided plane for searching the conductor pattern of the distributed phase type circular polarized wave antenna in the first preferred embodiment according to the invention.

As shown in FIG. 2, the virtual plane 19 is divided into a divided plane 10 by square small areas 11 (w×h=9×9=81). A calculator randomly determines two states of the small square area 11, i.e. as to whether the small square area 11 should be remained on the divided plane 10 or should be removed from the divided plane 10, to generate a probable antenna pattern (antenna candidate pattern).

For every antenna candidate pattern, a probable power feed point (candidate point) is set in inner sides of the square small areas 11 for all possibilities. For every possibility of the candidate point, antenna characteristics (an impedance matching state at the power feed point and an axis ratio in a distant radiated field) of the antenna candidate pattern is calculated. The antenna candidate patterns having the impedance matching and the axis ratio within an allowable range are adopted as the distributed phase type circular polarized wave antenna.

Figure 3:
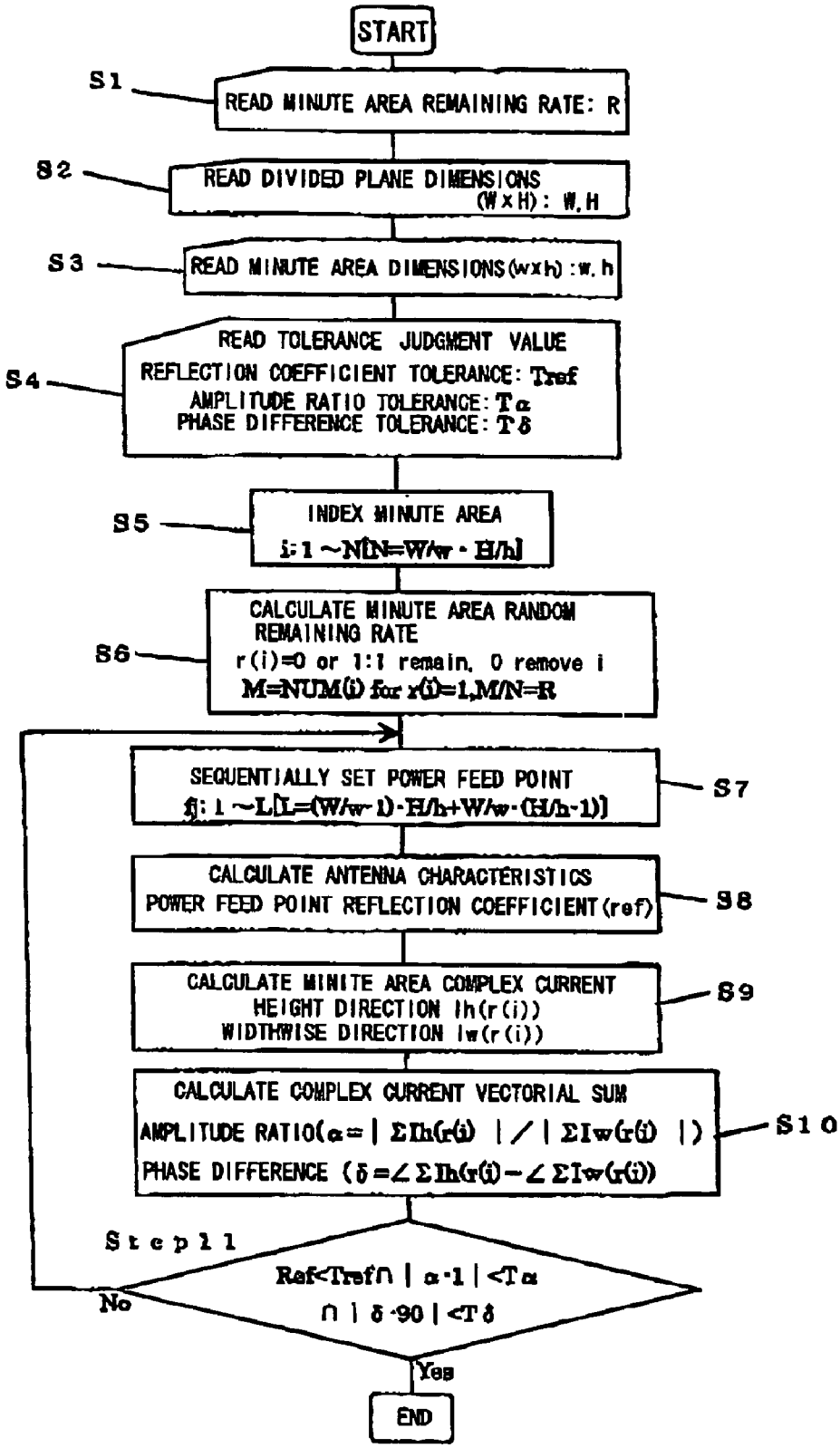
FIG. 3 is a flow chart showing a method for searching the conductor pattern of the distributed phase type circular polarized wave antenna in the first preferred embodiment according to the invention.

FIG. 3 is a flow chart for generating a random pattern.

At a step S1, a minute area remaining rate (R) is read.

At a step S2, divided (minute) plane dimensions (W×H) is read.

At a step S3, minute area dimensions (w×h) is read.

At a step S4, a reflection coefficient tolerance (Tref), an amplitude ratio tolerance (Tα), and a phase difference tolerance (Tδ) are read and set as tolerance judgment value.

The minute area remaining rate (R) is a remaining rate of square small areas 11 on the divided plane, and previously determined at a random removal process.

At a step S5, the minute areas on the divided plane are indexed. The indexing is conducted by successively numbering the small square areas 11 shown in FIG. 2 from 1 to N (=W/w×H/h) and incrementing them.

At a step S6, a minute area random remaining rate is calculated. For respective minute areas indexed at the step S5, it is judged as to whether the minute area is a remained area or a removed area, expressed as r(i)=0 or 1 (1 is remained area, and 0 is removed area). A total number (M=NUM(i)) of the remained areas (r(i)=1) is calculated, so that a remaining rate (R=M/N) is calculated.

At the steps S5 and S6, the antenna candidate pattern having a predetermined remaining rate R is randomly generated on the divided (minute) plane dimensions (W×H).

At a step S7, a power feed point (fj) is sequentially set in the minute areas in the antenna candidate pattern. In concrete, the power feed point (fj) is sequentially set from 1 to L (L=(W/w−1)×H/h+W/w×(H/h−1)).

A current distribution induced in respective minute areas is obtained by setting the power feed point (fj).

At a step S8, antenna characteristics are calculated from power feed point reflection coefficient (ref).

At a step S9, a complex current in the minute area is calculated. For every minute area, a complex current Ih(r(i)) in a vertical (height) direction and a complex current Iw(r(i)) in a horizontal (widthwise) direction are calculated.

At a step S10, a complex current vectorial sum is calculated after obtaining the complex current in the minute area at the step S9. Herein, an amplitude ratio α and a phase difference δ in two directions (the widthwise direction w and the height direction h) orthogonal to each other are calculated.

The amplitude ratio is given by:

$$\alpha=|\Sigma Ih(r(i))|/|\Sigma Iw(r(i))|.$$

The phase difference is given by:

$$\delta=\angle\Sigma Ih(r(i))-\angle\Sigma Iw(r(i)).$$

At a step S11, amplitude of a reflection coefficient (ref) is calculated, assuming unit voltage, based on a reverse number ($Ie^{-1}$) of an induced current value at the predetermined power feed point and a characteristic impedance (Zo) of a high-frequency circuit connected to a supposed antenna as follows;

$$\mathrm{ref}=|(Ie^{-1}-Zo)/(Ie^{-1}+Zo).$$

Next, it is judged as to whether the complex current vectorial sums in the directions h and w calculated at the step 10 are substantially equal in amplitude and a phase difference there between is about 90°.

This judgment is conducted by judging as to whether the complex current vectorial sums are within the tolerance judgment value read at the step S4. In other words, it is judged as to whether the reflection coefficient amplitude (ref) is within the reflection coefficient tolerance (Tref), whether the amplitude ratio (|α−1|) is within the amplitude ratio tolerance (Tα), and whether the phase difference from 90° (|δ−90°|) is within the phase difference tolerance (Tδ).

This judgment is given by:

$$\mathrm{ref}<T\mathrm{ref}\cap|\alpha-1|\cap<T\alpha\cap|\delta-90|<T\delta$$

According to this process, it is judged as to whether the amplitude of the sums in respective axes are substantially equal to each other, in concrete, a ratio of absolute values of the sums of the respective axes is from 0.7 to 1.3, more preferably from 0.9 to 1.1, and whether a phase difference is substantially 90°, in concrete, an absolute value of a difference between arguments of the sums in the respective axes is from 80° to 100°.

In the judgment at the step S11, if the above conditions are satisfied (No), the calculation flow is returned to the step S7, and repeated after changing the power feed point. If the above conditions are satisfied (Yes), the calculation flow is end.

In the first preferred embodiment, a single feed circular polarized wave antenna having a thin plate structure can be realized in a regular square area with dimensions of less than ¼ wavelength of the used electromagnetic wave. Therefore, the present invention has an effect of providing a small sized circular polarized wave antenna without using an additional material such as dielectric material, namely, without further increasing a fabrication cost.

Next, a distributed phase type circular polarized wave antenna in second to fifth preferred embodiment according to the present invention will be explained referring to FIGS. 4A, 4B, 5A, and 5B.

Figure 4A:
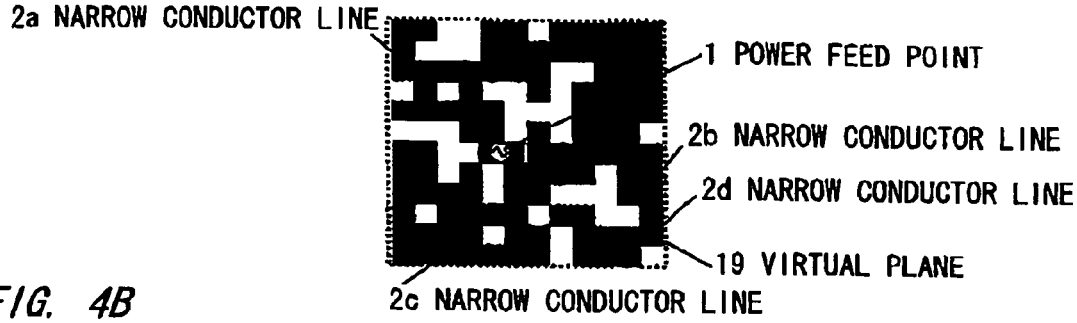
Figure 4B:
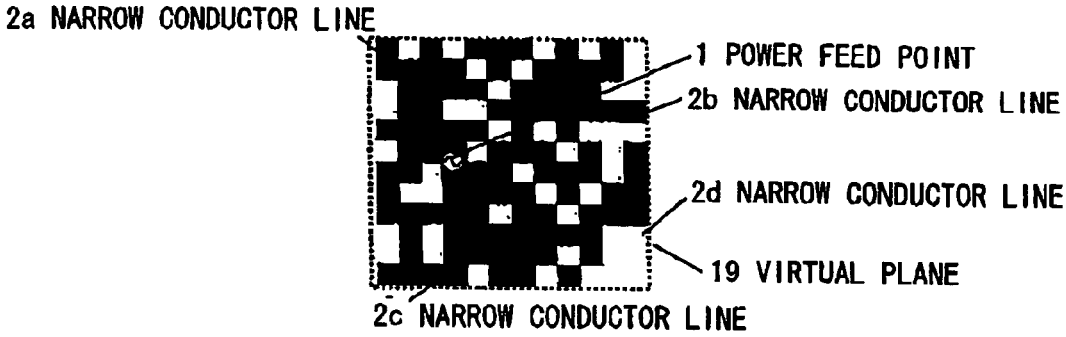
Figure 5A:
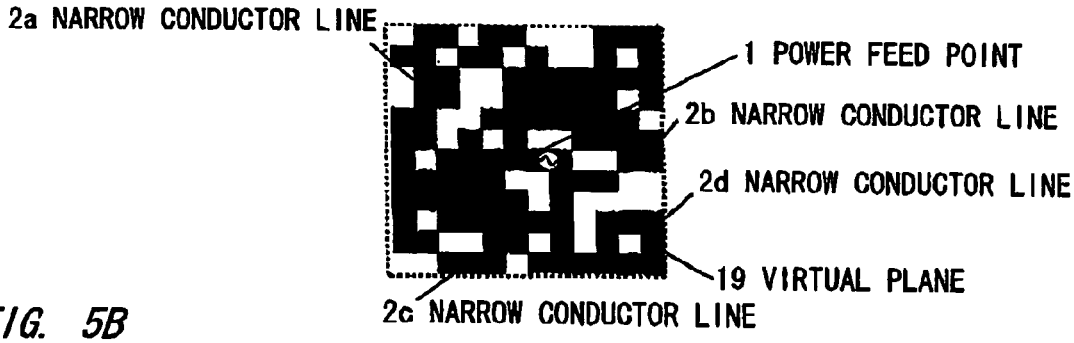
Figure 5B:
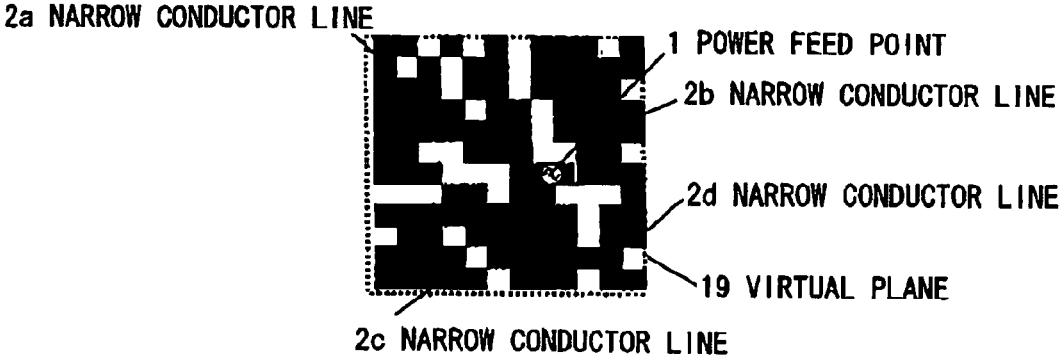

FIGS. 4A, 4B, 5A, and 5B are diagrams showing circular polarized wave antenna pattern structures of a distributed phase type circular polarized wave antenna in second to fifth preferred embodiment, obtained by the flow chart shown in FIG. 3, wherein the virtual plane 19 is composed of minute areas divided into 144 (=12×12), wherein FIG. 4A shows a circular polarized wave antenna calculated by using a minute area remaining rate (105/144; 73%), FIG. 4B shows a circular polarized wave antenna calculated by using a minute area remaining rate (97/144; 67%), FIG. 5A shows a circular polarized wave antenna calculated by using a minute area remaining rate (98/144; 68%), and FIG. 5B shows a circular polarized wave antenna calculated by using a minute area remaining rate (108/144; 75%).

Compared with the antenna structure in the first preferred embodiment, all conductors are integrally coupled with the power feed point 1 in the antenna structures in the second to fifth preferred embodiments, so that a punching process such as pressing can be used in manufacturing. Therefore, an effect for reducing the mass production cost can be provided.

A distributed phase type circular polarized wave antenna in a sixth preferred embodiment according to the invention will be explained referring to FIG. 6.

Figure 6:
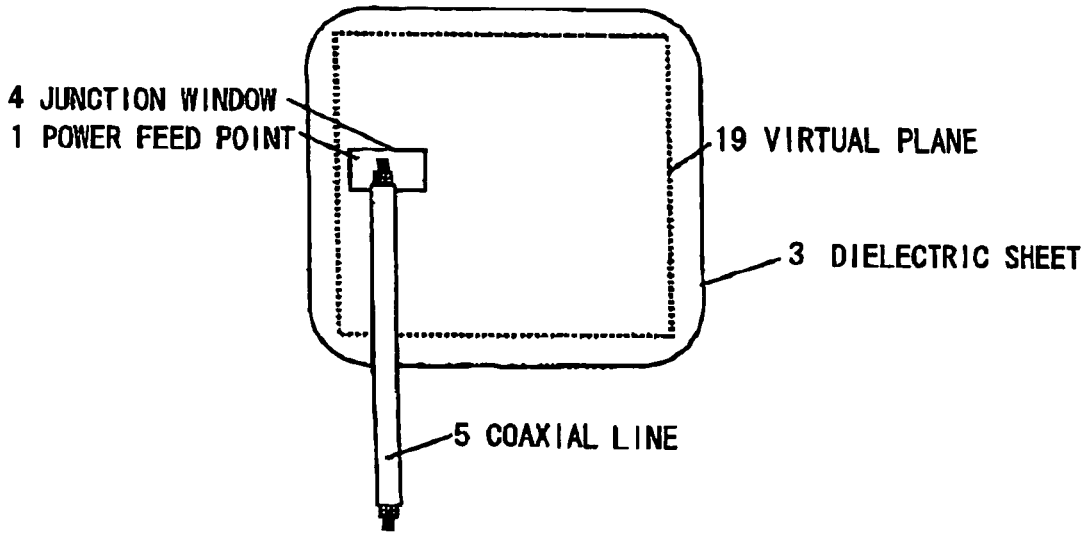
FIG. 6 is a plan view showing a structure of a distributed phase type circular polarized wave antenna in a sixth preferred embodiment according to the invention.

FIG. 6 is a diagram showing a structure of a distributed phase type circular polarized wave antenna in a sixth preferred embodiment according to the invention.

A virtual plane 19 on which a power feed point 1 and a group of narrow conductor lines 2 are formed is laminated with a thin dielectric sheet 3.

A junction window 4 is provided at a part of the dielectric sheet 3, and the power feed point 1 is not covered with dielectric sheet 3. At the junction window 4, both of a core and a jacket of a coaxial line (coaxial cable) 5 is electrically coupled to the power feed point at one end.

According to the sixth preferred embodiment, there are effects that deterioration of the conductor due to chemical reaction such as rust can be prevented, and that a reliability of the antenna parts can be improved. Further, the power feed point 1 of the antenna can be pulled out to the outside by the coaxial cable 5, so that it is possible to improve a freedom of arrangement of the antenna and a high-frequency circuit for providing a high-frequency power to the antenna in a radio communication device.

A distributed phase type circular polarized wave antenna in a seventh preferred embodiment according to the invention will be explained referring to FIG. 7.

Figure 7:
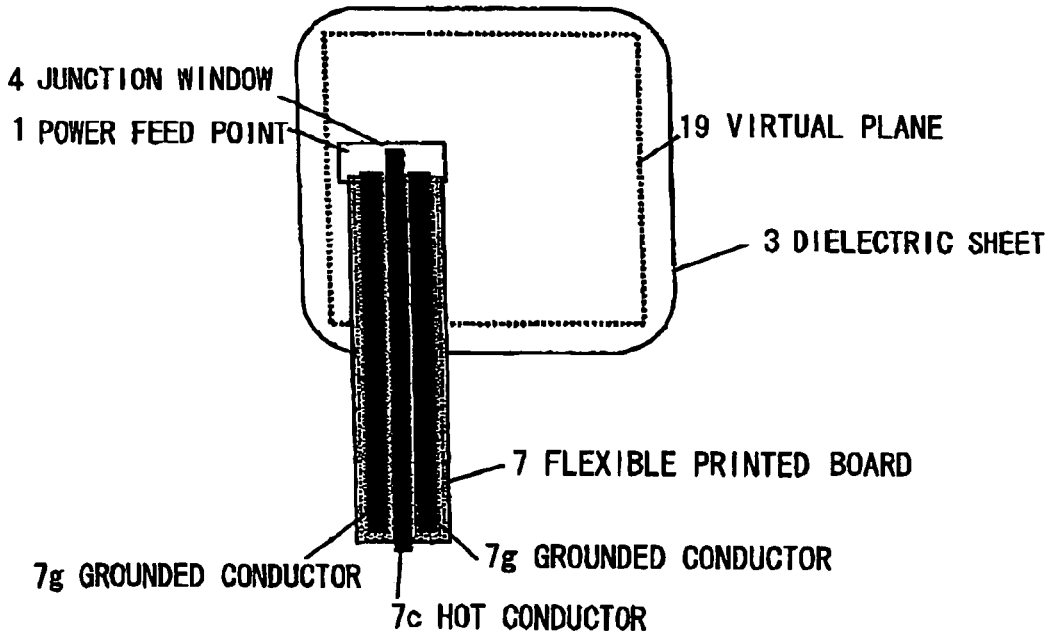
FIG. 7 is a plan view showing a structure of a distributed phase type circular polarized wave antenna in a seventh preferred embodiment according to the invention.

FIG. 7 is a diagram showing a structure of a distributed phase type circular polarized wave antenna in a seventh preferred embodiment according to the invention.

Features different from the sixth preferred embodiment shown in FIG. 7 are as follows. At the junction window 4, both of a hot conductor 7*c* and a grounded conductor 7*g* of coplanar lines formed by a flexible printed board 7 are electrically coupled to the power feed point 1.

According to the seventh preferred embodiment, the flexible printed board 7 can be used as a power feed line. Since the manufacturing cost of the flexible printed board is less expensive than the coaxial cable used in the sixth preferred embodiment, a manufacturing cost of a whole antenna can be reduced. Further, the power feed point 1 of the antenna can be pulled out to the outside by using the flexible printed board 7, so that it is possible to improve a freedom of arrangement of the antenna and a high-frequency circuit for providing a high-frequency power to the antenna in a radio communication device.

A distributed phase type circular polarized wave antenna in an eighth preferred embodiment according to the invention will be explained referring to FIG. 8.

Figure 8:
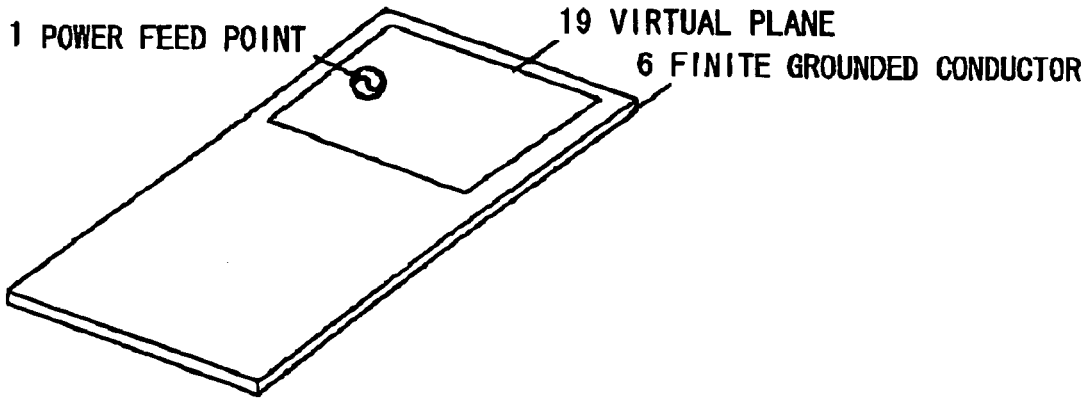
FIG. 8 is a perspective showing a structure of a distributed phase type circular polarized wave antenna in an eighth preferred embodiment according to the invention.

FIG. 8 is a diagram showing a structure of a distributed phase type circular polarized wave antenna in an eighth preferred embodiment according to the invention.

According to the structure in the eighth preferred embodiment, a distributed phase type circular polarized wave antenna comprising a virtual plane 19 shown in FIGS. 1, 4A, 4B, 5A, or 5B, a power feed point 1 and a group of narrow conductor lines 2*a*, 2*b*, 2*c* and 2*d* is provided on a finite grounded conductor 6 such as a circuit board.

When examining the characteristics of the distributed phase type circular polarized wave antenna candidates, it is possible to incorporate an electromagnetic effect of the finite grounded conductor. By using such an antenna search method, the antenna search previously incorporating a characteristics variation when the antenna is mounted on the circuit board can be realized, so that characteristics deterioration when the antenna is mounted on the radio communication terminal can be suppressed.

Figure 9:
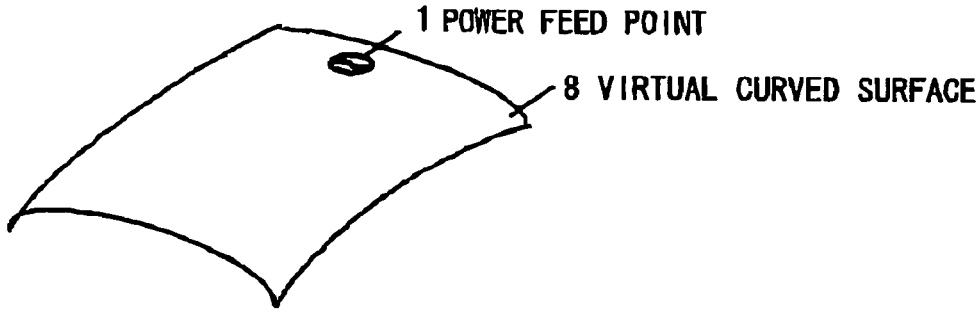
FIG. 9 is a perspective showing a structure of a distributed phase type circular polarized wave antenna in a ninth preferred embodiment according to the invention.

FIG. 9 is a diagram showing a structure of a distributed phase type circular polarized wave antenna in a ninth preferred embodiment according to the invention.

Features different from the first preferred embodiment shown in FIG. 1 are as follows. In place of the virtual plane 19, a virtual curved surface 8 is used, so that an antenna structure is obtained by the curved surface structure as a result.

The power feed point 1 and a plurality of narrow conductor lines 2 are formed on the convex curved surface 8. So as to show the total structure of the antenna, the narrow conductor lines 2 are omitted from FIG. 9. The narrow conductor lines 2 are distributed on the convex curved surface 8 similarly to the antenna in the first preferred embodiment shown in FIG. 1.

Herein, assuming a virtual plane (not shown) contacting the convex curved surface 8, a absolute values of sums of projections of complex vectors of current distributions induced on the narrow conductors in first and second directions orthogonal to each other defined on the convex curved surface are calculated. The amplitude ratio of the absolute values is from 0.7 to 1.3 and a phase difference of the absolute values is from 80° to 100°.

According to the structure in the ninth preferred embodiment, when mounting the distributed phase type circular polarized wave antenna according to the invention in the radio communication terminal, it is possible to change the antenna structure flexibly in accordance to a shape of a mounting area influenced by a design of the radio communication terminal, so that it is possible to improve a freedom of design of the radio communication terminal mounting the distributed phase type circular polarized wave antenna according to the invention.

Figure 10A:
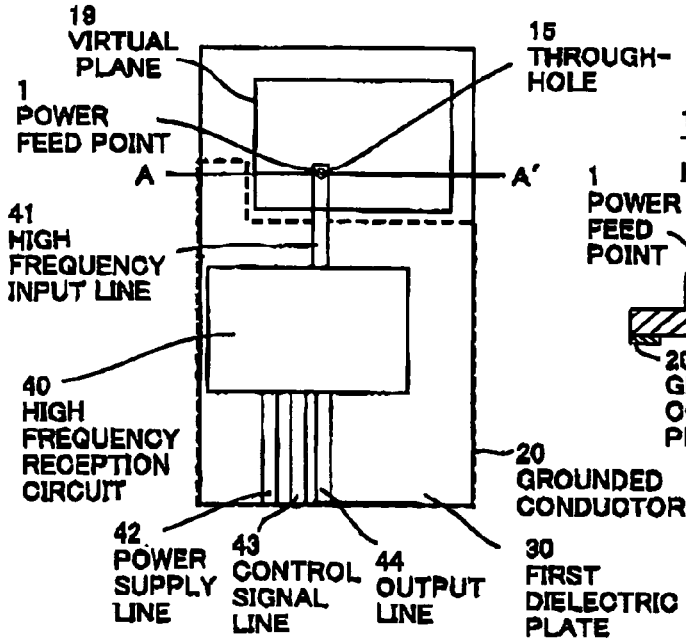
Figure 10B:
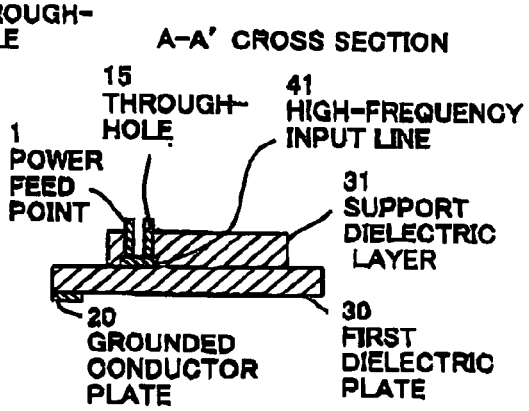

FIGS. 10A and 10B show a high-frequency module in the tenth preferred embodiment according to the present invention, wherein FIG. 10A is a plan view, and FIG. 10B is a cross sectional view of FIG. 10A cut along A-A' line.

In FIGS. 10A and 10B, a high-frequency reception circuit 40, which uses a grounded conductor plate 20 as a common ground potential plate, is formed on a plane of a dielectric plate 30 facing to the grounded conductor plate 20. A distributed phase type circular polarized wave antenna structure formed on a virtual plane 19 shown in FIGS. 1, 4A, 4B, 5A and 5B is provided on a first dielectric plate 30 via a support dielectric layer 31. Further, a high-frequency input line 41 of the high-frequency reception circuit 40 is formed on an opposite plane, and is coupled with a power feed point 1 of a distributed phase type circular polarized wave antenna via a through-hole formed in the support dielectric plate 31, and a power supply line 42, a control signal line 43 and an output line 44 of the high-frequency reception circuit 40 are formed.

In case where the power feed point 1 of the distributed phase type circular polarized wave antenna is positioned at a peripheral part of the virtual plane 19, the through-hole 15 is formed as a facet through-hole at a side surface of the support dielectric layer 31, so that the power feed point 1 and the high-frequency input line 41 are coupled with each other via the through-hole 15.

In this high-frequency module, a reception signal voltage generated at the power feed point 1 of the antenna is input to the high-frequency reception circuit 40 through the high-frequency input line 41. Processing such as amplification, frequency determination and waveform shaping by using a filter, frequency down conversion, etc. are conducted for the reception signal voltage to be converted into a intermediate frequency or baseband frequency, and the signal is supplied to outside of the high-frequency module through the output line 44. A power source and a control signal of the high-frequency reception circuit 40 are respectively supplied from the outside of the high-frequency module through the power supply line 42 and control signal line 43.

According to the tenth preferred embodiment, since a thin high-frequency reception module integrating an antenna can be realized, a volume of the high-frequency receiving module itself can be reduced, a freedom of design for mounting the high-frequency module on a radio device can be improved, and an occupying volume of the high-frequency receiving module within the radio device can be reduced. As a result, it is effective for miniaturization and sliming of the radio device.

An eleventh preferred embodiment of the present invention will be explained referring to FIGS. 11A and 11B.

Figure 11A:
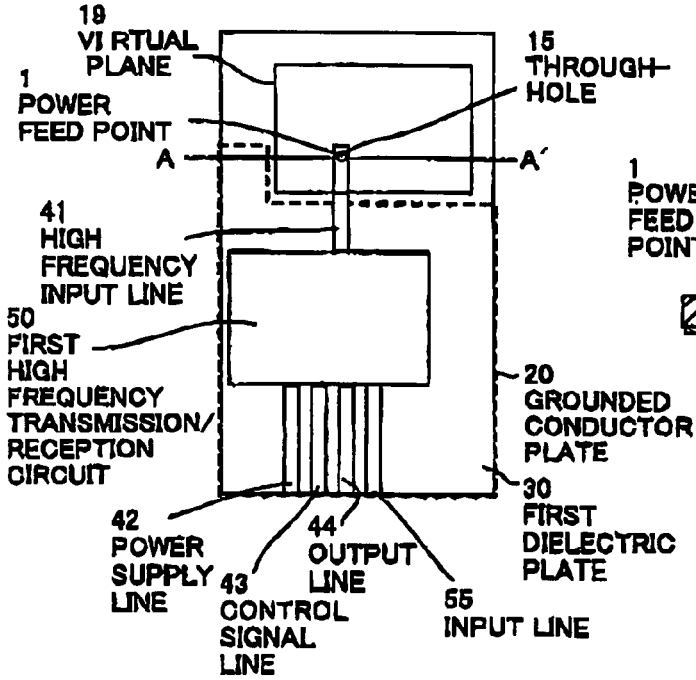
Figure 11B:
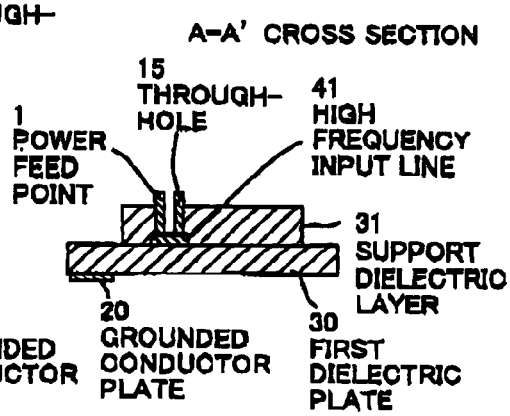

FIGS. 11A and 11B show a high-frequency module in the eleventh preferred embodiment according to the present invention, wherein FIG. 11A is a plan view, and FIG. 11B is a cross sectional view of FIG. 11A cut along A-A' line.

The eleventh preferred embodiment is different from the ninth preferred embodiment shown in FIGS. 11A and 11B in following points. A high-frequency transmission/reception circuit 50 is provided instead of the high-frequency reception circuit 40. Further, an input line 55 connected to the high-frequency transmission/reception circuit 50 is formed on a plane of the first dielectric plate 30 facing to the grounded conductor plate 20.

In this high-frequency module, a transmission/reception signal voltage generated at the power feed point 1 of the antenna is input to or output from the high-frequency transmission/reception circuit 50 through the high-frequency input line 41. Processing such as amplification, frequency determination and waveform shaping by using a filter, frequency down conversion, etc. are conducted for the transmission/reception signal voltage to be converted into a intermediate frequency or baseband frequency, and the signal is transmitted to or received from the outside of the module through the output line 44 or the input line 55. A power source and a control signal of the high-frequency transmission/reception circuit 50 are respectively supplied from the outside of the module through the power supply line 42 and control signal line 43.

According to the eleventh preferred embodiment, since a thin type high-frequency transmission/reception module integrating an antenna can be realized, a volume of the high-frequency transmission/reception module itself can be reduced, a freedom of design for mounting the high-frequency module on a radio device can be improved, and an occupying volume of the high-frequency receiving module within the radio device can be reduced. As a result, it is effective for miniaturization and sliming of the radio device.

A twelfth preferred embodiment of the present invention will be explained referring to FIGS. 12A to 12C.

Figure 12A:
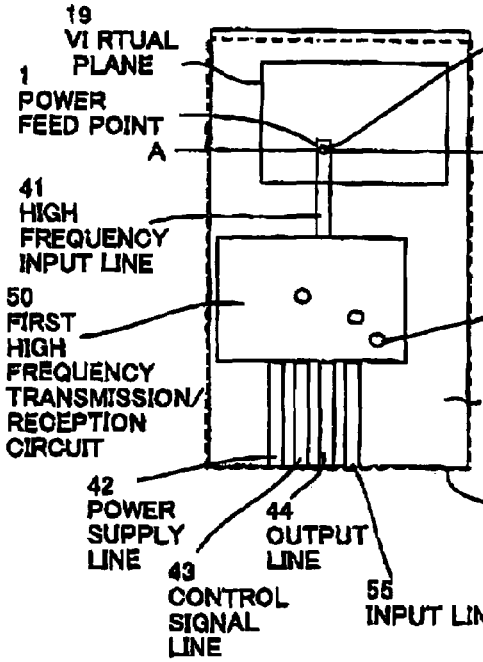
Figure 12B:
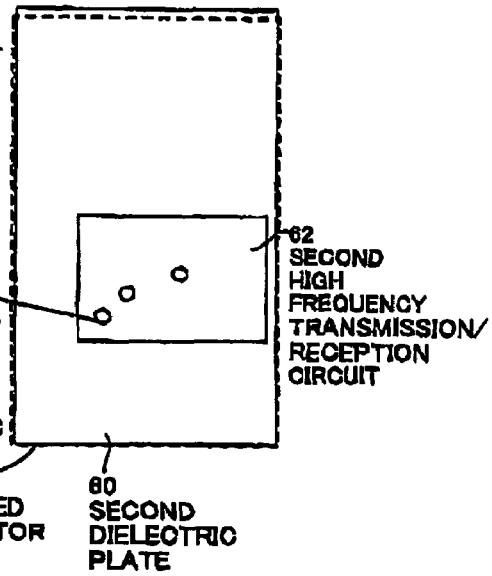
Figure 12C:
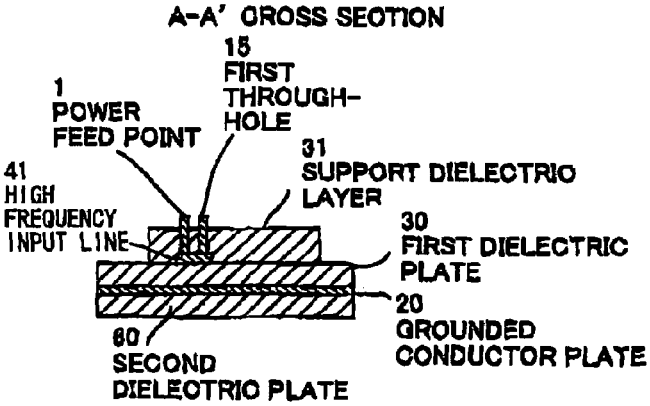

FIGS. 12A to 12C show a high-frequency module in the twelfth preferred embodiment according to the present invention, wherein FIG. 12A is a plan view, FIG. 12B is a bottom view, and FIG. 12C is a cross sectional view of FIG. 12A cut along A-A' line.

The twelfth preferred embodiment is different from the eleventh preferred embodiment shown in FIGS. 11A and 11B in following points. A second dielectric plate 60 is formed on a plane of the grounded conductor plate 20 other than a plane on which a first dielectric plate 30 is formed. A second high-frequency transmission/reception circuit 62 is formed on a plane of the second dielectric plate 60 facing to and other than a plane on which the grounded conductor plate 20 is formed. A power source and a control signal of the first high-frequency transmission/reception circuit 50 and the second high-frequency transmission/reception circuit 62 are respectively transmitted to and received from the outside of the module through a second through hole 61 formed on the first dielectric plate 30 and the second dielectric plate 60.

According to the twelfth preferred embodiment, since a thin high-frequency transmission/reception module can be formed on both sides of the high-frequency module, a surface area of the thin module can be reduced. As a result, it is effective for miniaturization of the radio device, namely reduction of a total surface area of the radio device rather than sliming of the radio device.

A thirteenth preferred embodiment of the present invention will be explained referring to FIGS. 13A to 13C.

Figure 13A:
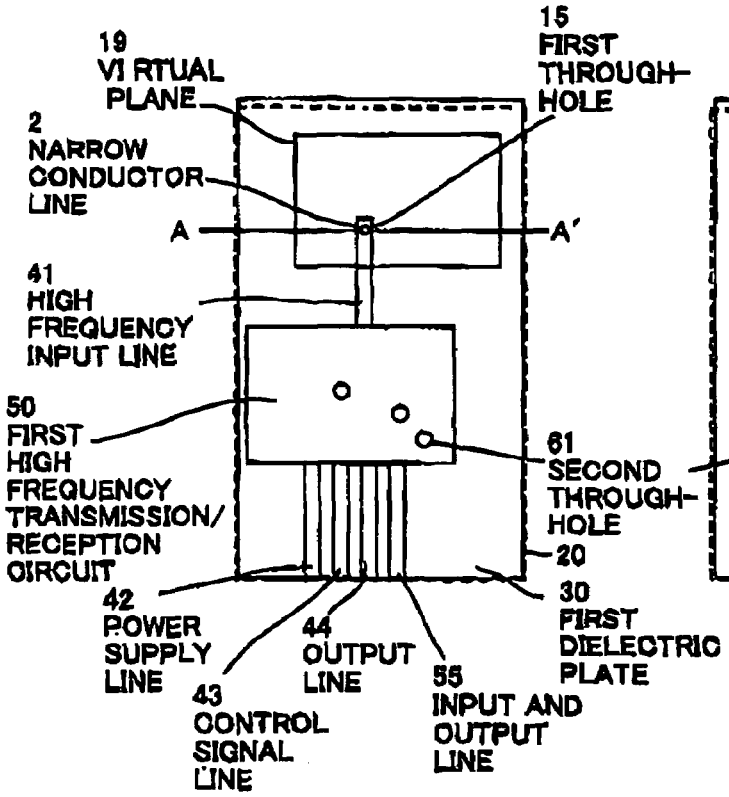
Figure 13B:
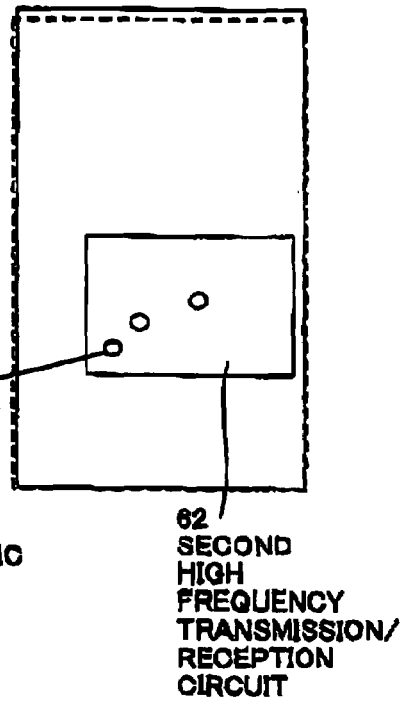
Figure 13C:
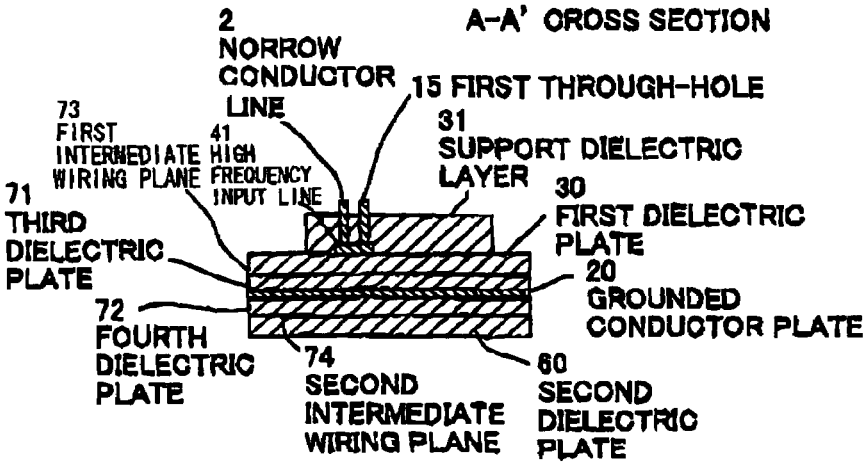

FIGS. 13A to 13C show a high-frequency module in the thirteenth preferred embodiment according to the present invention, wherein FIG. 13A is a plan view, FIG. 13B is a bottom view, and FIG. 13C is a cross sectional view of FIG. 13A cut along A-A' line.

The thirteenth preferred embodiment is different from the eleventh preferred embodiment shown in FIGS. 11A to 11C in following points. A third dielectric plate 71 is formed between the grounded conductor plate 20 and the first dielectric plate 30, and a fourth dielectric plate 72 is formed between the grounded conductor plate 20 and the second dielectric plate 60. A first intermediate wiring plane 73 is formed on an interface plane between the first dielectric plate 30 and the third dielectric plate 71, and a second intermediate wiring plane 74 is formed on an interface plane between the second dielectric plate 60 and the fourth dielectric plate 72. A power source and a control signal of the first high-frequency transmission/reception circuit 50 and a second high-frequency transmission/reception circuit 62 are respectively transmitted to and received from the outside of the module through a second through-hole 61 formed on the first dielectric plate 30 and the second dielectric plate 60, as well as through a wiring pattern formed on the first intermediate wiring plane 73 and a wiring pattern formed on the second intermediate wiring plane 74.

According to the thirteenth preferred embodiment, compared with the twelfth preferred embodiment shown in FIGS. 12A and 12B, since a thin high-frequency transmission/reception module can be formed within the module as well as on both sides of the module, a surface area of the thin module can be further reduced. As a result, it is effective for miniaturization of the radio device, namely reduction of a total surface area of the radio device rather than sliming of the radio device.

A fourteenth preferred embodiment of the present invention will be explained referring to FIG. 14.

Figure 14:
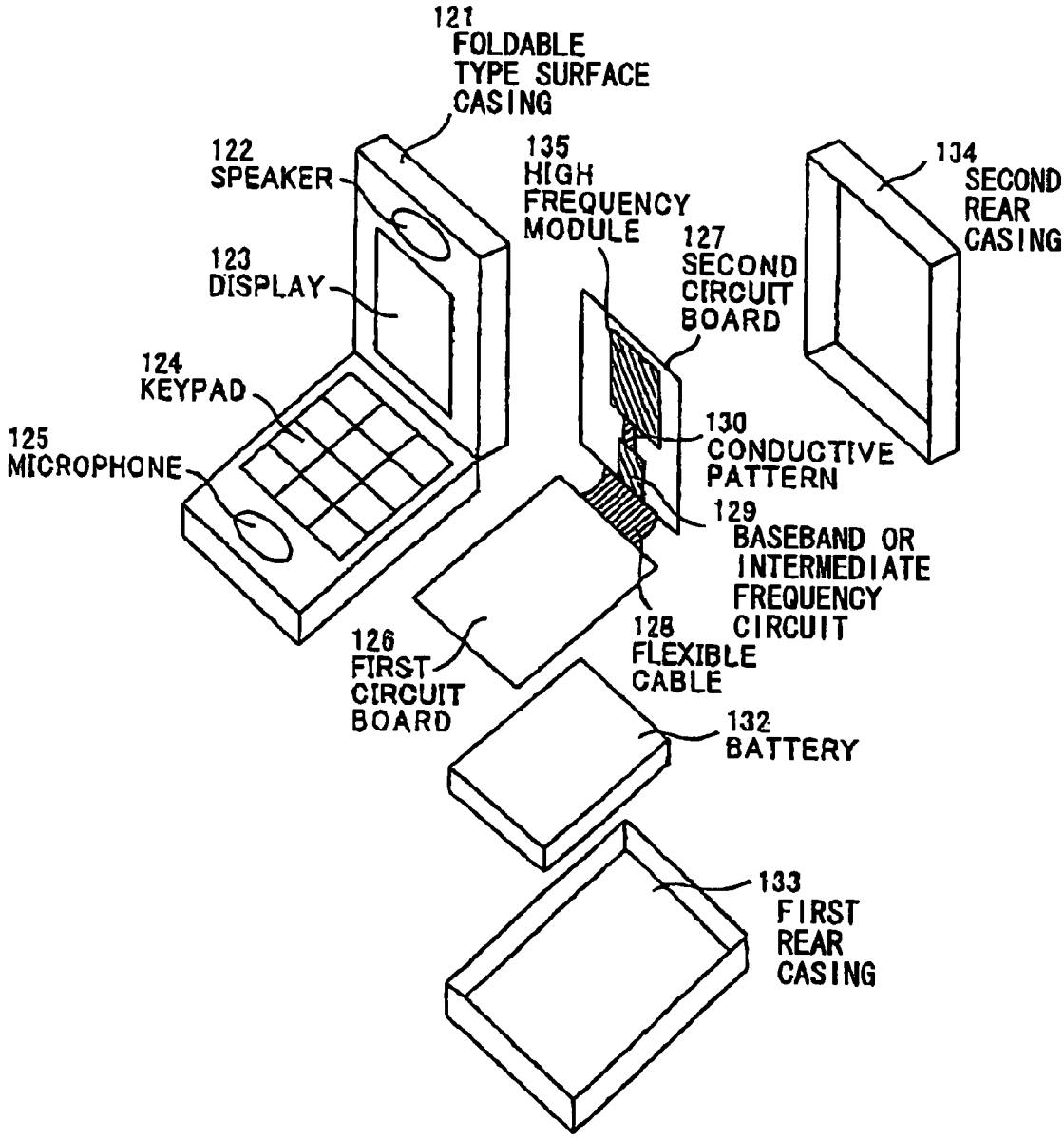
FIG. 14 is a disassembled perspective view of a radio communication device mounting a high frequency module in a fourteenth preferred embodiment according to the present invention.

FIG. 14 shows a disassembled perspective view of a communication device mounting a high-frequency module in the thirteenth preferred embodiment according to the present invention.

A speaker 122, a display 123, a keypad 124, and a microphone 125 are mounted on a foldable type surface casing 121. A first circuit board 126 and a second circuit board 127 are connected by a flexible cable 128 accommodated within the foldable type casing 121. On the first circuit board 126 and/or second circuit board 127, a baseband or intermediate frequency circuit 129 and a high-frequency module 135 according to the invention are mounted, and a conductive pattern 130 coupling a signal of the high-frequency module 135 and the baseband or intermediate frequency circuit 129, a control signal, and a power source is formed thereon. The first circuit board 126 and second circuit board 127 together with a battery 132 are accommodated in a first rear casing 133 and a second rear casing 134.

A characteristic feature of this structure is that the high-frequency module 135 according to the present invention is sandwiched by the first circuit board 126 or the second circuit board 127 and the casing 121, and located on an opposite side of the display 123 or the speaker 122.

According to the fourteenth preferred embodiment, a radio terminal enjoying plural radio system services can be realized in a form of a built-in antenna. Therefore, it is effective in miniaturization of the radio terminal and improvement of user's convenience for storage and portability.

A fifteenth preferred embodiment of the present invention will be explained referring to FIG. 15.

Figure 15:
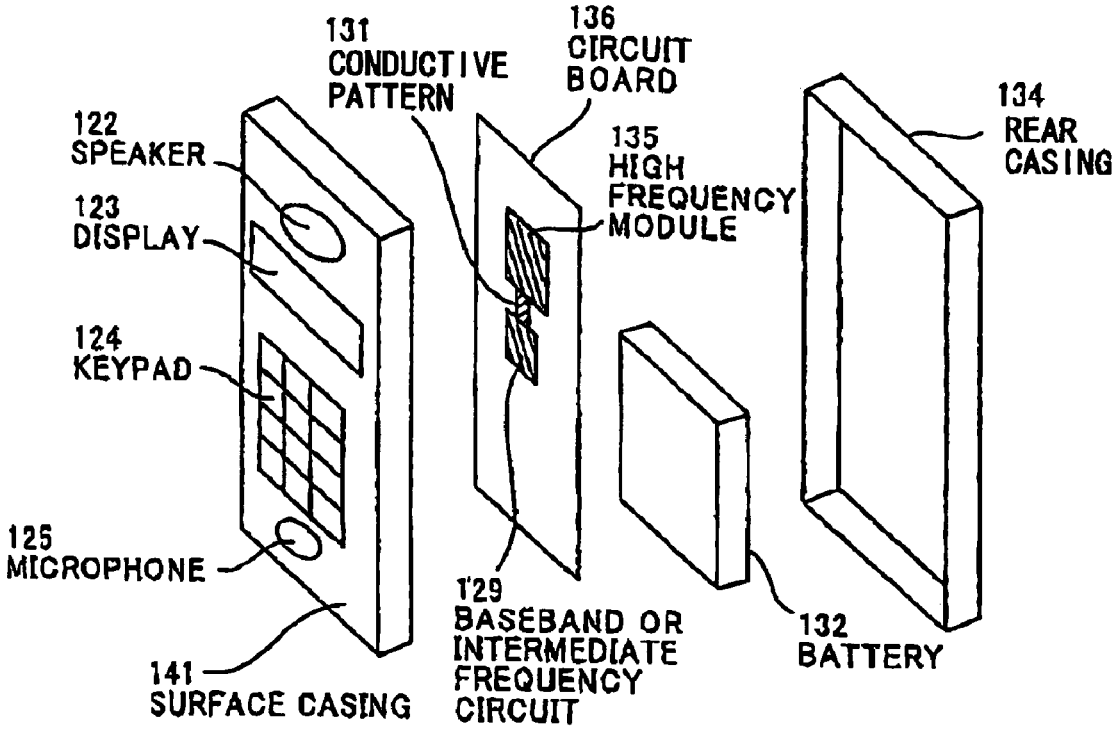
FIG. 15 is a disassembled perspective view of a communication device mounting a high frequency module in a fifteenth preferred embodiment according to the present invention.

FIG. 15 shows a disassembled perspective view of a communication device mounting a high-frequency module in the fifteenth preferred embodiment according to the present invention.

A speaker 122, a display 123, a keypad 124, and a microphone 125 are mounted on a surface casing 141, and a circuit board 136 is accommodated within the surface casing 141. On the circuit board 136, a baseband or intermediate frequency circuit 129 and a high-frequency module 135 according to the invention are mounted, and a conductive pattern 131 coupling a signal of the high-frequency module 135 and the baseband or intermediate frequency circuit 129, a control signal, and a power source is formed. The circuit board 136 together with a battery 132 is accommodated in a rear casing 134.

A characteristic feature of this structure is that the high-frequency module 135 according to the present invention is l sandwiched between the circuit board 136 and the surface casing 141 and located on an opposite side of the display 123, the microphone 125, the speaker 122, or the keypad 124.

According to the thirteenth preferred embodiment, a radio terminal enjoying plural radio system services can be realized in a form of a built-in antenna. Therefore, it is effective in miniaturization of the radio terminal and improvement of user's convenience for storage and portability.

Compared with the fourteenth preferred embodiment shown in FIG. 14, since the circuit board and the casing can be fabricated integrally, it is effective for miniaturization of the terminal surface and reduction of manufacturing cost by reducing the number of assembling steps.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A distributed phase type circular polarized wave antenna, comprising:

a power feed point and a plurality of narrow conductors formed on a common plane, the narrow conductors having a substantially one-dimensional current distribution and being distributed in two dimensions, wherein the power feed point comprises a signal connection point and a ground connection point, wherein a signal line and a ground connection line are electrically connected to the narrow conductors respectively, wherein absolute values of sums of projections of complex vectors of current distributions induced on the narrow conductors in first and second directions orthogonal to each other defined on the common plane are determined in amplitude and phase, such that an amplitude ratio of the absolute values is from 0.7 to 1.3 and a phase difference of the absolute values is from 80° to 100°.

2. The distributed phase type circular polarized wave antenna, according to claim 1, wherein:

the narrow conductors are coupled to each other and the power feed point is included in the narrow conductors.

3. The distributed phase type circular polarized wave antenna, according to claim 1, wherein:

the narrow conductors are formed on a grounded conductor plate having a finite grounding potential.

4. The distributed phase type circular polarized wave antenna, according to claim 3, wherein:

a space between the narrow conductors and the conductor plate is filled with a dielectric material.

5. The distributed phase type circular polarized wave antenna, according to claim 3, wherein:

a space between the narrow conductors and the conductor plate is filled with a magnetic material.

6. The distributed phase type circular polarized wave antenna, according to claim 2, further comprising:

a thin dielectric sheet laminating the narrow conductors.

7. The distributed phase type circular polarized wave antenna, according to claim 2, further comprising:

a coaxial cable having an end coupled to the power feed point and another end being a power feed point for connection to outside.

8. The distributed phase type circular polarized wave antenna, according to claim 2, further comprising:

a flexible printed cable having an end coupled to the power feed point and another end being a power feed point for connection to outside.

9. The distributed phase type circular polarized wave antenna, according to claim 4, further comprising:

a layered conductor comprising dielectric layers formed on a surface of the grounded conductor plate; and a conductor formed in the dielectric material, the conductor being connected to the power feed point and coupled to the layered conductor.

10. The distributed phase type circular polarized wave antenna, according to claim 4, further comprising:

a layered conductor comprising dielectric layers formed on a surface of the grounded conductor plate; and a conductor formed on a side surface of the dielectric material, the conductor being connected to the power feed point and coupled to the layered conductor.

11. The distributed phase type circular polarized wave antenna, according to claim 5, further comprising:

a layered conductor comprising dielectric layers formed on a surface of the grounded conductor plate; and a conductor formed in the magnetic material, the conductor being connected to the power feed point and coupled to the layered conductor.

12. The distributed phase type circular polarized wave antenna, according to claim 5, further comprising:

a layered conductor comprising dielectric layers formed on a surface of the grounded conductor plate; and a conductor formed on a side surface of the magnetic material, the conductor being connected to the power feed point and coupled to the layered conductor.

13. The distributed phase type circular polarized wave antenna, according to claim 1, wherein:

the power feed point comprises a balanced feed point.

14. The distributed phase type circular polarized wave antenna, according to claim 1, wherein:

the distributed phase type circular polarized wave antenna has a planar structure.

15. The distributed phase type circular polarized wave antenna, according to claim 1, wherein the signal connection point comprises a point to which a core or a hot conductor is connected, and the ground connection point comprises a point to which a jacket or a ground conductor is connected.

16. A distributed phase type circular polarized wave antenna, according to claim 1, wherein the signal line and the ground connection line are directly connected to the narrow conductors.

17. A distributed phase type circular polarized wave antenna, comprising:

a power feed point and a plurality of narrow conductors formed on a common convex curved surface, the narrow conductors having a substantially one-dimensional current distribution and being distributed in two dimensions, wherein:

absolute values of sums of projections, on a plane contacting the common convex curved surface, of complex vector additional values of respective current distributions induced on the narrow conductors in first and second directions orthogonal to each other defined on the common convex curved surface are determined in amplitude and phase, such that an amplitude ratio of the absolute values is from 0.7 to 1.3 and a phase difference of the absolute values is from 80° to 100°.

18. The distributed phase type circular polarized wave antenna, according to claim 17, wherein:

the power feed point comprises a balanced feed point.

19. The distributed phase type circular polarized wave antenna, according to claim 17, wherein:

the distributed phase type circular polarized wave antenna has a curved planar structure.

20. A high-frequency module, comprising:

a distributed phase type circular polarized wave antenna which comprises:

a power feed point; and a plurality of narrow conductors formed on a common plane, the narrow conductors having a substantially one-dimensional current distribution and being distributed in two dimensions, wherein the power feed point comprises a signal connection point and a ground connection point, wherein a signal line and a ground connection line are electrically connected to the narrow conductors respectively, and wherein absolute values of sums of projections of complex vectors of current distributions induced on the narrow conductors in first and second directions orthogonal to each other defined on the common plane are determined in amplitude and phase, such that an amplitude ratio of the absolute values is from 0.7 to 1.3 and a phase difference of the absolute values is from 80° to 100°.

21. The high-frequency module, according to claim 20, wherein:

the power feed point comprises a balanced feed point.

22. The high frequency module, according to claim 20, wherein the signal connection point comprises a point to which a core or a hot conductor is connected, and the ground connection point comprises a point to which a jacket or a ground conductor is connected.

23. A portable radio terminal, comprising:

a distributed phase type circular polarized wave antenna which comprises:

a power feed point; and a plurality of narrow conductors formed on a common plane, the narrow conductors having a substantially one-dimensional current distribution and being distributed in two dimensions, wherein the power feed point comprises a signal connection point and a ground connection point, wherein a signal line and a ground connection line are electrically connected to the narrow conductors respectively, and wherein absolute values of sums of projections of complex vectors of current distributions induced on the narrow conductors in first and second directions orthogonal to each other defined on the common plane are determined in amplitude and phase, such that an amplitude ratio of the absolute values is from 0.7 to 1.3 and a phase difference of the absolute values is from 80° to 100°.

24. A The portable radio terminal, according to claim 23, wherein:

a high-frequency module includes the distributed phase type circular polarized wave antenna.

25. The portable radio terminal, according to claim 23, wherein:

the power feed point comprises a balanced feed point.

26. The portable radio terminal, according to claim 23, wherein the signal connection point comprises a point to which a core or a hot conductor is connected, and the ground connection point comprises a point to which a jacket or a ground conductor is connected.

* * * * *